United States Patent [19]

Colonna

[11] Patent Number: 4,911,300

[45] Date of Patent: Mar. 27, 1990

[54] CONTAINER PACKAGING SYSTEM

[76] Inventor: Ralph Colonna, 1335 Main St., St. Helena, Calif. 94574

[21] Appl. No.: 301,794

[22] Filed: Jan. 25, 1989

Related U.S. Application Data

[63] Continuation-in-part of Ser. No. 77,886, Jul. 27, 1987, abandoned.

[51] Int. Cl.[4] ..... B65D 71/00; B65D 85/62

[52] U.S. Cl. ..... 206/427; 206/433

[58] Field of Search ..... 206/427, 432, 433; 215/10.5

[56] References Cited

U.S. PATENT DOCUMENTS

| | | | |
|---|---|---|---|
| 1,367,069 | 1/1921 | MacKinnon | 206/427 |
| 1,574,904 | 3/1926 | Kucera | 206/433 |
| 1,957,263 | 5/1934 | Gray | 215/100.5 |
| 2,314,198 | 3/1943 | De Reamer | 206/433 |
| 2,990,968 | 7/1961 | Pirman | 215/100.5 |
| 3,351,264 | 11/1967 | Bostrom | 206/433 |
| 3,650,395 | 3/1972 | Hobbs | 206/432 |
| 4,093,068 | 6/1978 | Smrt | 206/433 |
| 4,142,634 | 3/1979 | Leff | 206/433 |
| 4,606,454 | 8/1986 | Hambleton | 206/432 |

FOREIGN PATENT DOCUMENTS

| | | | |
|---|---|---|---|
| 1474782 | 2/1967 | France | 206/433 |
| 1569978 | 6/1969 | France | 206/433 |

*Primary Examiner*—George E. Lowrance
*Attorney, Agent, or Firm*—Kolisch, Hartwell & Dickinson

[57] ABSTRACT

A container packaging system is provided which is particularly suitable for use in packaging wine bottles. The system includes a pair of thermo formed contoured trays which cooperate with a carton to provide a secure and attractive package. The trays are formed into contoured patters which include locating depressions into which the bottles are inserted. The bottom tray grips and securely holds the bottoms of the bottles. The system prevents scuffing of the labels on the bottles, preserving their attractive appearance.

8 Claims, 5 Drawing Sheets

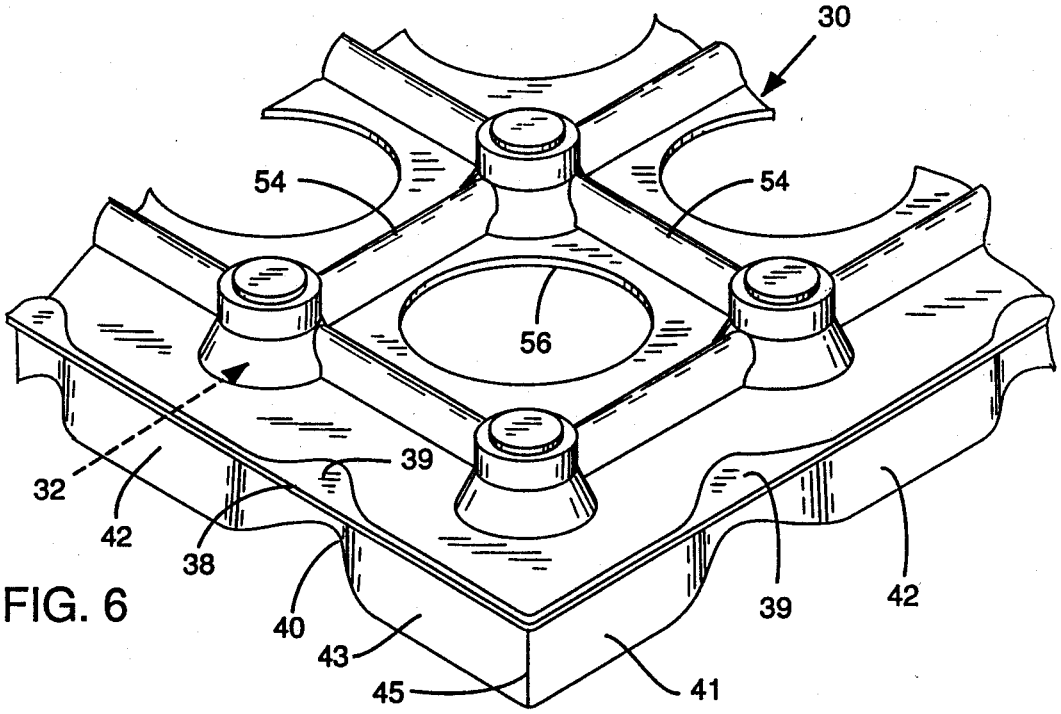
FIG. 6
FIG. 5
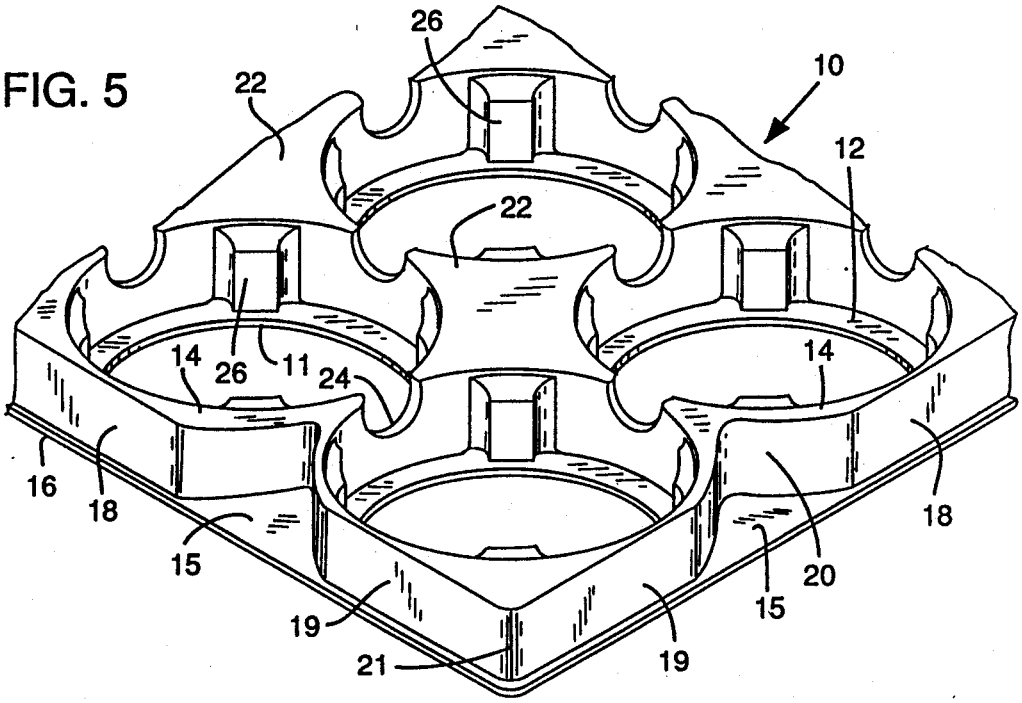

CONTAINER PACKAGING SYSTEM

BACKGROUND OF THE INVENTION

This patent application is a continuation-in-part of application Ser. No. 07/077,886, filed July 27, 1987, now abandoned, by the same inventor as the present application.

This invention relates generally to packaging for containers and more specifically to packaging for the storage and shipment of glass bottles in cartons.

Glass bottles which ar packaged for shipment in cartons made of cardboard or the like must be protected from shifting or moving against one another to avoid breakage. Damage and breakage of bottles in shipment and handling is both costly and detrimental to marketing. The wine industry in the United States is a large user of glass bottles packaged in cardboard cartons. The standard wine bottle holds 750 ml., has one of several traditional tapered or shouldered cylindrical shapes and has circular bottom and top ends of substantially different diameters. Wine bottles are generally boxed in sturdy cardboard cartons in case lots of twelve. Traditionally, the bottles have been protected within the cartons by means of cardboard partitions which surround each bottle. While such packaging generally protects the bottles against breakage it does have drawbacks A significant problem with traditional wine-bottle packaging results from the frequent tendency of the bottles to rotate or scuff against the cardboard partitions or the carton itself. While such scuffing rarely presents a breakage problem, it does tend to degrade the labels on some bottles. Labels are an important factor in marketing wines and damaged or degraded labels can be detrimental to the appeal of the wine, both on a retail shelf and in restaurants.

It would be advantageous to have a packaging system for wine and other beverage bottles which both protects the bottles packaged and shipped in case lot cartons against breakage and which also eliminates the problem of label scuffing which occurs during shipment and handling.

SUMMARY OF THE INVENTION

Accordingly, a container packaging system is provided for holding a plurality of rigid bottles in spaced apart but secure relationship to one another within a carton. The system is suitable for bottles which have tops and bottoms of differing diameters. The packaging system comprises top and bottom contoured trays which are thermo formed from thin sheets of synthetic plastic material. The bottom tray is formed into a plurality of locating depressions into which the bottom ends of the bottles are inserted. The top tray is formed into a plurality of locating depressions, corresponding in number and location to the depressions in the bottom tray, into which the tops of the bottles are inserted. A rectangular carton is provided which has opposed, substantially parallel top and bottom ends of substantially equal size and four rectangular side walls which extend perpendicularly between the ends. Each of the bottom and top trays have a substantially rectangular outer perimeter which corresponds in length and breadth to the length and breadth of the bottom and top ends of the carton. Each tray also is formed to include sides which extend along portions of its rectangular perimeter; the sides being perpendicular to the trays themselves. The perpendicular sides of the trays are shaped to fit within the carton such that, when the bottom tray is adjacent the bottom of the carton and the top tray is adjacent the top of the carton, the sides of the trays extend adjacent to the sides of the carton. Consequently, the trays fit snugly within the carton to prevent movement of both the trays and bottles held between the opposed locating depressions in the trays.

Each portion of the side of the bottom tray, around the perimeter of the tray, is in the form of a raised ridge formed in the synthetic plastic material. Each ridge is flat along the side facing the outer perimeter of the bottom tray and is contoured on the interior side of the ridge to form a portion of one of the locating depressions adjacent the outer perimeter.

In use, the bottom and top trays are inserted into the carton with their respective locating depressions facing one another, with the bottle extending between them. That will prevent contact and damage to the bottles during shipment and handling.

BRIEF DESCRIPTION OF THE DRAWINGS

FIG. 5 is an enlarged perspective view of a portion of the bottom contoured tray of FIGS. 1 and 2 showing the shape of a bottom locating depression and perimeter ridge.

FIG. 6 is an enlarged perspective view of a portion of the top contoured tray of FIGS. 3 and 4 showing the shape of a top locating depression as viewed from the reverse side from the first side shown in FIG. 1.

DETAILED DESCRIPTION OF THE PREFERRED EMBODIMENT

The present invention is a container packaging system for holding a plurality of rigid bottles in spaced relation to one another within a carton. Top and bottom trays formed of relatively lightweight plastic are used, together with a rectangular carton, to hold the bottles in position. Because of the weight of the filled wine bottles, the need to securely hold the bottles within a carton to prevent breakage, add the relative lightness of the tray material, the shape and pattern of the trays is important to the present invention.

Figure 1:
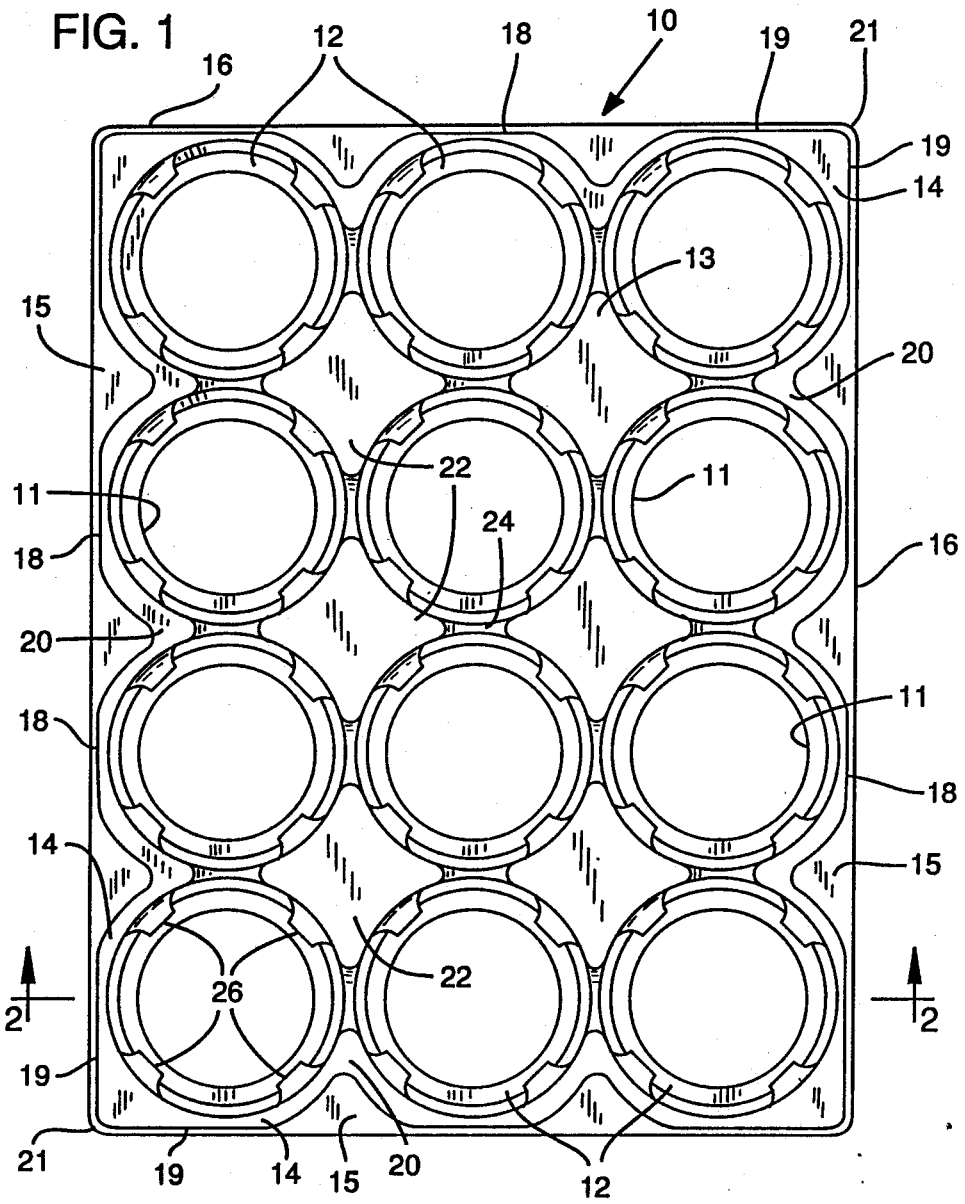
FIG. 1 is a plan view of the first side of the bottom, thermo formed, contoured tray, which includes locating depressions for receiving the bottom ends of bottles, in accordance with the present invention.
Figure 2:
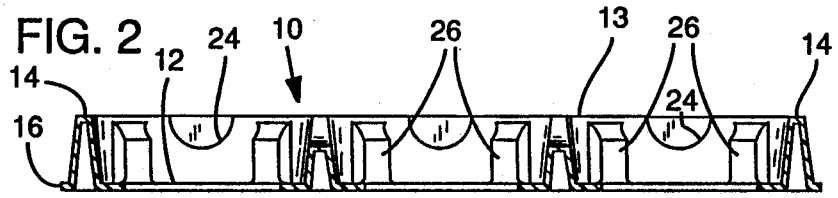
FIG. 2 is a cross-sectional view of the bottom contoured tray of FIG. 1, taken along line 2–2.

FIGS. 1 and 2 show the bottom tray for use in a rectangular carton in accordance with the present invention. The bottom tray 10 is preferably thermo formed into contours from a thin sheet of synthetic plastic material by conventional thermo forming techniques. The pattern formed in bottom tray 10 includes a plurality of locating depressions 12 formed on a first surface 13 of the sheet from which the tray is formed. The bottom ends of bottle will be inserted into depressions 12 when the bottom tray is in use. In the preferred embodiment the tray is designed to accommodate twelve bottles having circular bottoms. Tray 10 has a rectangular shape and the locating depressions 12 are arranged in a pattern of four depressions by three. Locating depressions 12 each have a generally circular shape, corresponding to the shape of the bottles, and are of a size large enough to receive the bottoms of the bottles within the depressions. Openings 11 can be provided through tray 10 as required in the thermo forming process, for example, in the bottom of depressions 12.

Bottom tray 10 is formed to include a contoured ridge 14 which extends in a sinuous pattern around the substantially rectangular perimeter 1 of the tray. Ridge 14 is raised generally perpendicularly to first surface 13 of the tray, as is best illustrated in cross-section in FIG. 2 and also in FIG. 5. Portions of ridge 14 extend adjacent to the perimeter and portions of ridge 14 extend interior from the perimeter of the tray. Generally triangular flat lips 55 of the plastic material are present at those portions of the tray perimeter 16 where the ridge 14 is not adjacent the perimeter. Lips 15 are remaining unmolded portions of the original plastic sheet, the remainder of which was thermo formed into the contours shown in FIGS. 1, 2 and 5.

Those portions 18 of ridge 14 which are adjacent to the peripheral edge of the tray are termed the sides of the tray. The sides 18 are generally flat and, when the tray is in use in a carton, each portion of each side 18 will extend adjacent to the sides of the carton, as will be described below. At the corners of the tray, ridge 14 is formed into two flat side portions 19 which meet in a small radius curve at the corners 21 (See FIG. 5). The other side portions 18 are separated from one another along the perimeter by indentations 20 and lips 15.

On the interior side of ridge 14, opposite each side portion 18, the ridge is contoured to form a portion of one of the locating depressions 12. Other portions of ridge 14, where the ridge itself is formed interior from perimeter !6, for example at 20 in FIG. 1, the ridge further defines the shape of the locating depressions 12. The bottom tray also includes six raised portions 22 which are generally diamond shaped with concave circular sides. Raised portions 22 serve to complete the circular shape of the locating depressions 12. In the preferred embodiment, raised portions 22 are the same height as ridge 14. Between the raised portions 22 and ridge 14, and also between adjacent raised portions 22, are semicircular depressions 24 which extend between adjacent locating depressions 12.

Within each locating depression 12 are a plurality of protuberances 26 formed in the plastic material for gripping and holding a bottle within each locating depression. In the preferred embodiment each protuberance 26 is a tapered, elongated projection which extends generally inward into the locating depression. The protuberances 26 are located opposed to one another within each depression and serve to grip a bottle between them.

Figure 3:
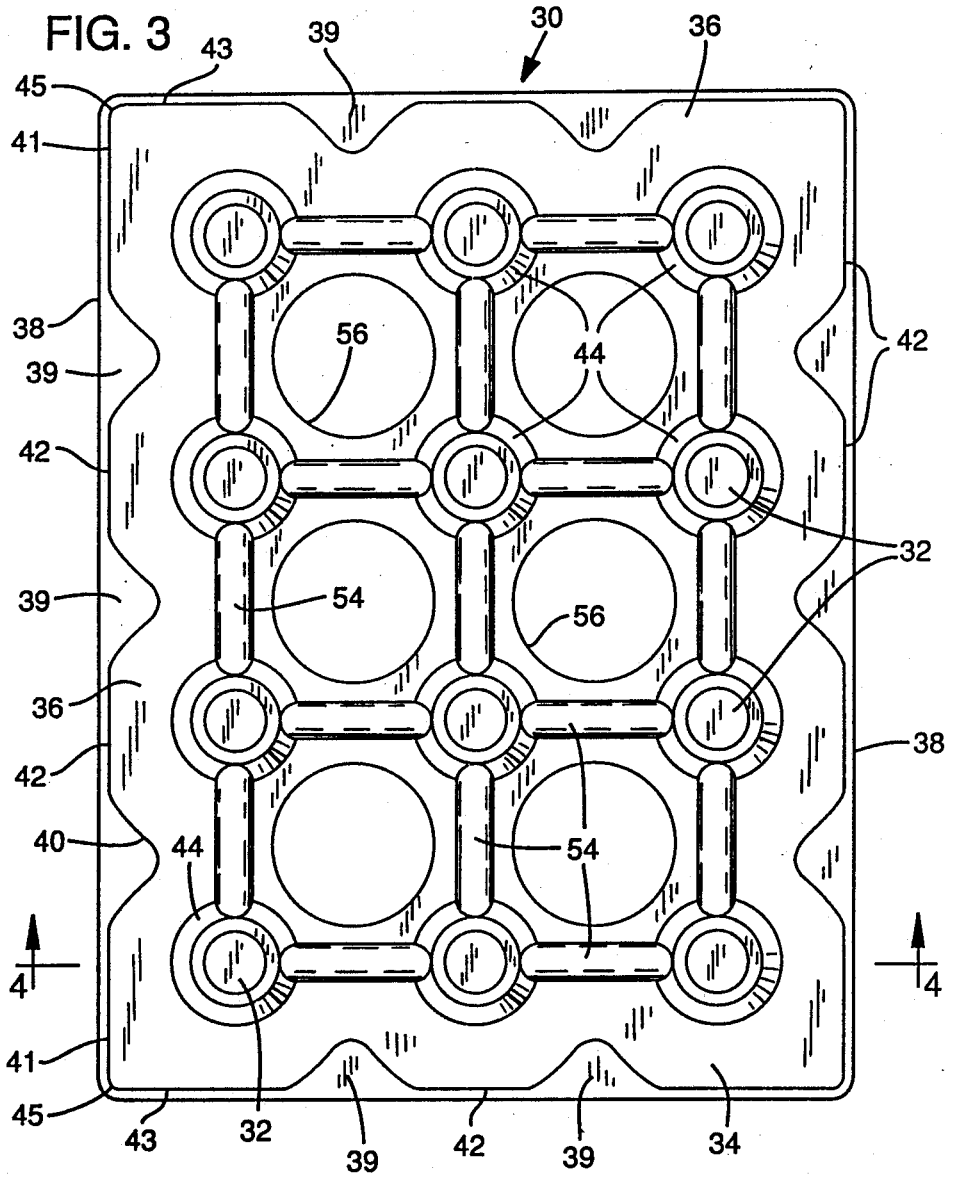
FIG. 3 is a plan view of the first side of the top contoured tray, which includes locating depressions for receiving the top ends of bottles, in accordance with the present invention.
Figure 4:
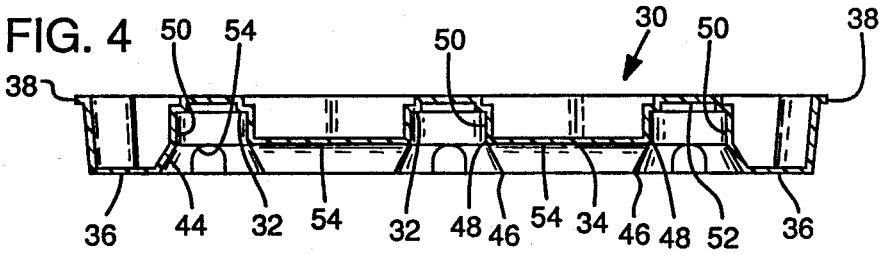
FIG. 4 is a cross-sectional view of the top contoured tray of FIG. 3, taken along line 4–4.

Referring to FIGS. 3 and 4, a top tray 30 is illustrated in accordance with the present invention. Like bottom tray 10, top tray 30 is thermo formed from a thin sheet of synthetic plastic material into a contoured pattern. The top tray includes a plurality of locating depressions 32 formed on a first surface 34 of the tray. The number and pattern of locating depressions 32 on the top tray corresponds to the number and pattern of locating depressions 12 on bottom tray 10.

Top tray 30 has a generally rectangular shape and is formed to include a generally flat, broad ridge 36 which extends in a sinuous pattern around the perimeter 38 of the tray. Ridge 36 is raised generally perpendicularly to first surface 34 of tray 30, as best illustrated in cross-section in FIG. 4 and as viewed from the back, or second side of the tray in FIG. 6. Portions of ridge 36 extend adjacent to the perimeter 38 and portions extend interior from the perimeter; an example of the latter being at 40 in FIG. 3. As with bottom tray 10, top tray 30 includes lips 39 where remaining unmolded portions of the original plastic sheet remain. Lips 39 are generally triangular, flat pieces of plastic. Those portions 42 of ridge 36 which are adjacent to the peripheral edge of the tray are termed the sides of tray 30. Ridge 36 is formed into two adjacent flat portions 41 and 43 at each corner (see FIG. 5) joined by a small radius curve 45 at each corner. The other side portions 42 of tray 30 are separated from one another by indentations 40 and lips 39. Sides 42 are generally flat and, when the tray is in use in a carton, each portion of each side 42 will extend adjacent to the sides of the carton, as will be described below.

Ridge 36 extends between the perimeter 38 and the locating depressions 32 closest to the perimeter of the tray. The ridge helps to define the locating depressions, which are shaped to include a generally tapered surface 44 extending from a larger diameter at the opening 46 of the locating depression and tapering to a smaller diameter deeper into the depression, at 48. The part of each locating depression 32 which is deepest into the depression changes to a substantially non-tapered cylindrical shape, at 50 in FIG. 4, between the smaller-diametered end 48 of tapered surface 44 and the bottom 52 of the depression. The above-described shape of depressions 32 aids in guiding the tops of the bottles into the depressions, facilitating packaging of bottles with the present invention.

Top tray 30 also is formed to include generally straight ridges 54 of the plastic material from which the tray is formed, which extends between adjacent pairs of the locating depressions. Ridges 54 are best seen in FIG. 3, extending perpendicular to on another between locating depressions 32. In the preferred embodiment the ridges extend between the tapered portions 44 of the locating depressions. The ridges 54 enhance the structural rigidity of the top tray.

Openings 56 are also formed in top tray 30 to assist in installing and removing the tray from a carton and to permit viewing into the carton. The openings 56 are between the locating depressions 32, as shown in FIG. 3, and are circular in shape.

FIGS. 5 and 6 illustrate the contours and patterns formed in the respective bottom and top contoured trays of FIGS. 1–4. The perspective view provides an alternative view of the structure of the tray described in detail above.

Figure 7:
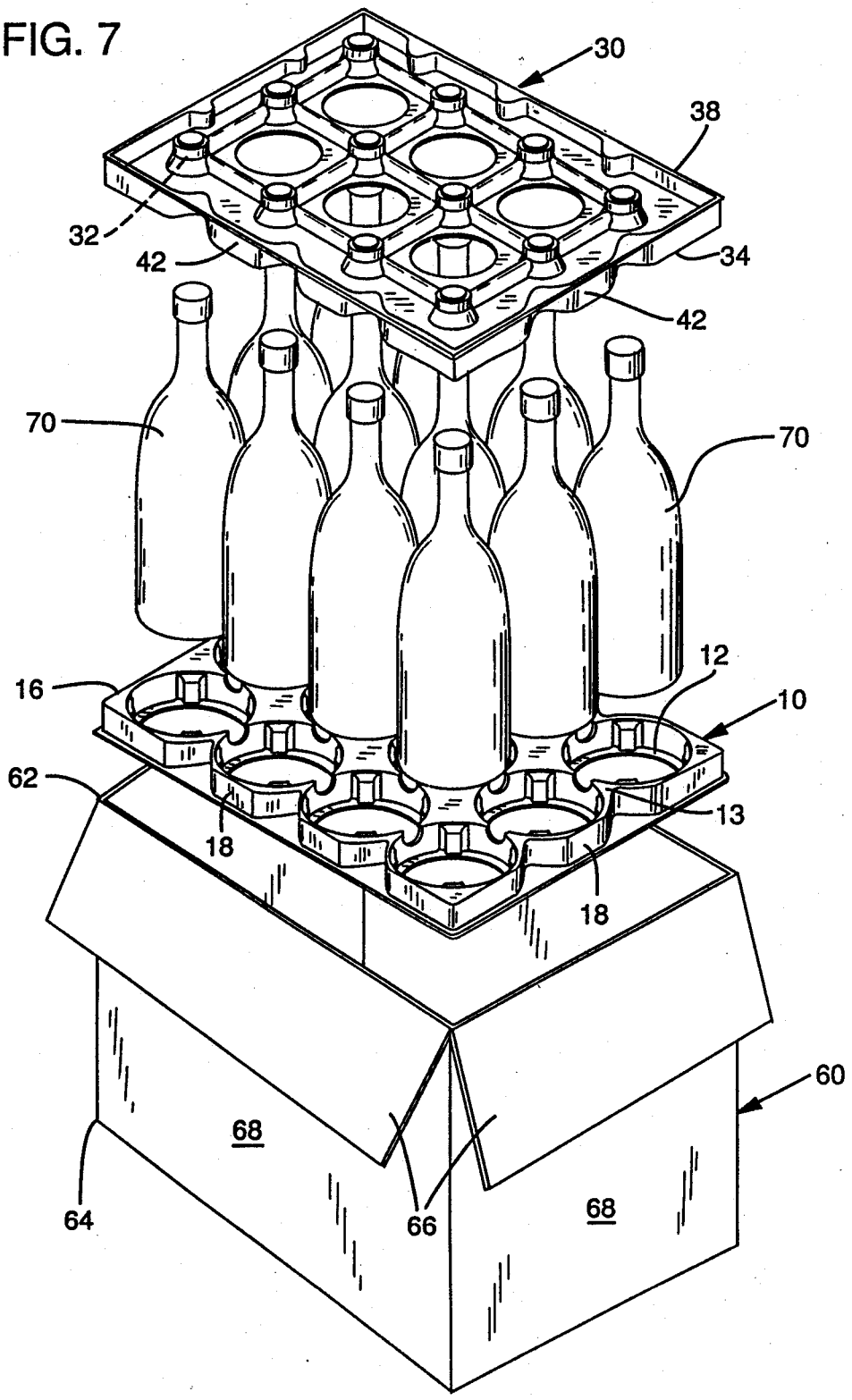
FIG. 7 is an isometric exploded view on a reduced scale showing the bottom and top contoured trays in schematic, together with a carton, as used in the present invention, illustrating the relationship of the parts of the invention as used in the packaging of twelve wine bottles.
Figure 8:
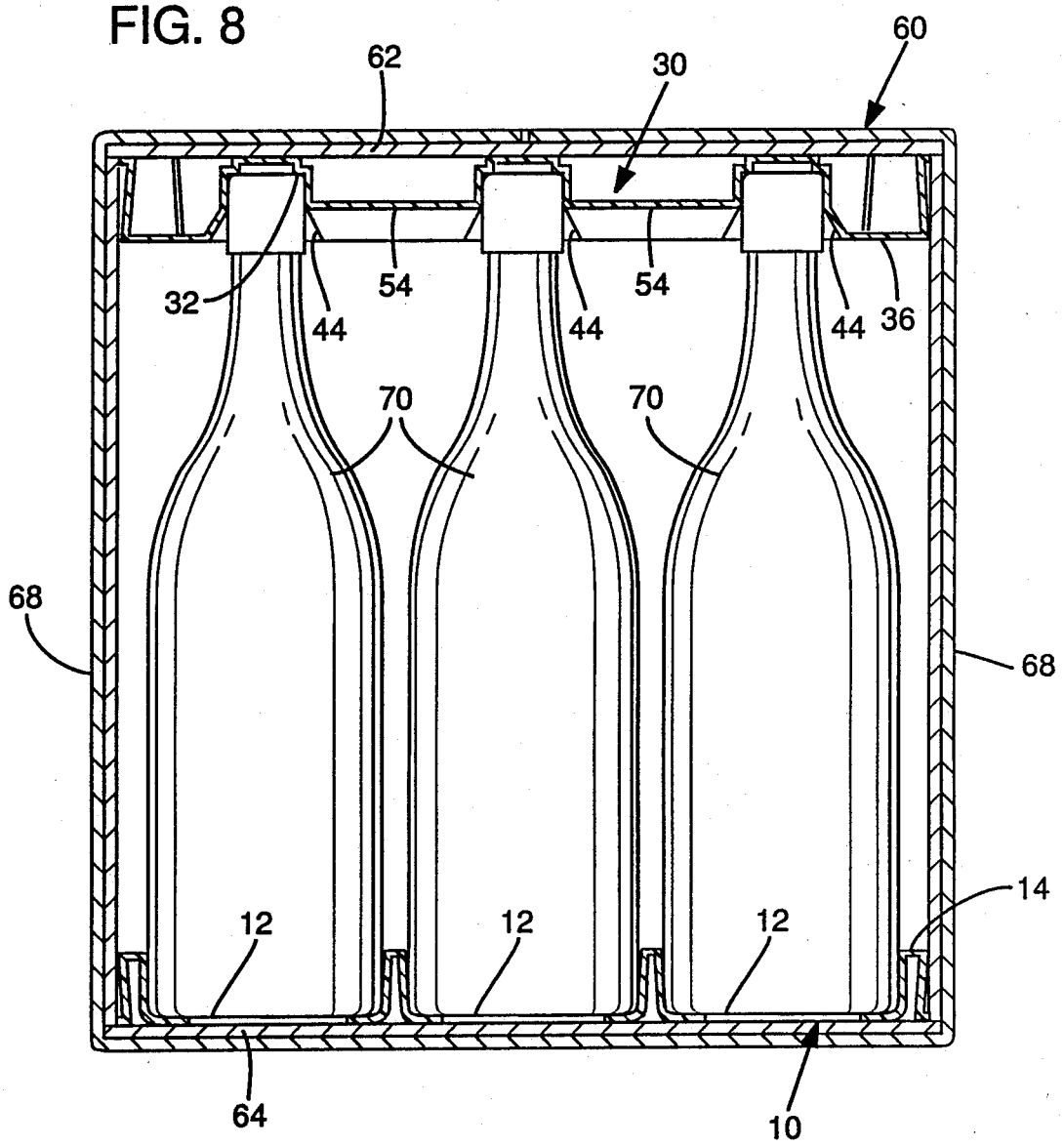
FIG. 8 is a partial cross sectional view of portions of the bottom and top contoured trays and carton of the present invention, illustrating how the various parts are used together with wine bottles.

Referring to FIGS. 7 and 8, the use of the packaging system of the present invention in packaging twelve wine bottles is illustrated. Bottom and top trays 10 and 30, respectively, cooperate with a rectangular carton 60 which is the proper size to effectively cooperate with trays 10 and 30, as described below. Carton 60 is rectangular and includes opposed, substantially parallel top and bottom ends 62 and 64, respectively. Top end 62 is open as illustrated in FIG. 7 but can be conveniently closed by folding first one and then the other pair of flaps 66 over the open top end 62, in the well-known manner. Carton 60 also includes four rectangular sides 68 extending perpendicularly between bottom and top ends 62 and 64 to complete the rectangular carton.

The dimensions of carton 60 and bottom and to trays 10 and 30 must be correct to cooperate in the proper functioning of the present invention. Both bottom tray 10 and top tray 30 have substantially rectangular outer perimeters, 16 and 38, respectively, which substantially corresponding in length and breadth to the interior length and breadth of the bottom and top ends, 62 and 64, respectively, of carton 60. Thus, when bottom tray 10 is in use adjacent the bottom end 62 of carton 60, the sides 18 of tray 10 extend adjacent the sides 68 of carton 60 such that the tray fits snugly within the carton. Similarly, when top tray 30 is in use adjacent the top end 64 of carton 60, the sides 42 of tray 30 extend adjacent the sides 68 of carton 60, also providing a snug fit between the tray and the box.

When the packaging system is in use, plurality of bottles 70 extend between the bottom and top trays as illustrated in FIGS. 7 and 8. The bottles are inserted into the respective locating depressions 12 and 32 of the respective bottom and top trays. In its final packaged form, the entire assembly of bottom and top trays as arranged such that the respective first surfaces 13 and 34 of trays 10 and 30, respectively, are in opposed relation to one another. Bottles 70 are disposed between the trays as shown in FIGS. 7 and 8. All are installed within carton 60 before the carton is closed, as shown in FIG. 8.

Preferably, assembly of the packaging system occurs as follows: Bottom tray 10 is first placed in carton 60. Then bottles 70 are inserted in the locating depressions 12, with protuberances 26 holding the bottles securely against turning. Top tray 30 is then installed over the tops of the bottles with the locating depressions 32 opening downward. The carton is then closed and the bottles are held in spaced relation to one another. In its preferred form, bottom tray 10 includes locating depressions only for receiving the bottom ends of bottles and the top tray includes locating depressions only for receiving the top ends of bottles. Therefore, bottles are packages oriented in the same direction to one another.

The present invention has several advantages over prior art wine bottle packaging systems. Because the bottles are separated from one another and their labels do not come in contact with either the box or partitions, the labels are not scuffed nor degraded. If the carton is to be used for retail display, it can be partially cut away and the top tray removed, revealing the bottles in an open array. The protuberances in the bottom tray tend to hold the bottles securely in such an display, which makes for a far more attractive package than with either loose bottles or bottles separated by cardboard partitions. The packaging system is relatively lightweight and inexpensive and is suitable for many shapes and sizes of wine bottles. It is necessary that the locating depressions be of the correct size, particularly for the bottoms of the bottles, which vary more in size than the tops. Various size bottom tray locating depressions can be provided to accommodate the full range of bottles produced.

The container packaging system of the present invention provides a convenient system for packaging wine and other beverage bottles. It both protects the bottles and eliminates the problem of label scuffing during shipment and handling.

What is claimed is:

1. A container packaging system for holding a plurality of rigid bottles having opposed first and second ends of different diameters, comprising: top and bottom contoured trays thermo formed from thin sheets of synthetic plastic material into patterns, said bottom tray being formed into a plurality of locating depressions on a first surface thereof for receiving the bottom ends of rigid bottles therein, said top tray being formed into a plurality of locating depressions on a first surface thereof, corresponding in number to said locating depressions on said bottom tray, for receiving the top ends of rigid bottles therein, a rectangular carton having opposed, substantially parallel top and bottom ends of substantially equal size and four rectangular sides extending perpendicularly between said ends for receiving a plurality of rigid bottles corresponding in number to said locating depressions on said trays, each said bottom and top trays having a substantially rectangular outer perimeter substantially corresponding in length and breadth to the length and breadth of said bottom and top ends of said carton and each tray being formed to include sides extending along portions of its respective perimeter which are perpendicular to said tray such that when said bottom and top trays are placed in said carton adjacent said bottom and top ends, respectively, said sides of said trays extend adjacent said sides of said carton to fit snugly within said carton, each portion of each side of said bottom tray being a raised ridge formed in said synthetic plastic material which includes a generally flat portion along the side of said ridge facing the outer perimeter of said bottom tray and which is contoured on the interior side of said ridge to form a portion of one of said locating depressions, whereby when said bottom tray is located in said carton adjacent said bottom end thereof, said top tray is located in said carton adjacent said to end thereof and a plurality of rigid bottles are disposed in said locating depressions between said trays in said carton, the bottles are held in said locating depressions of said trays preventing contact and damage to the bottles.

2. A container packaging system as in claim 1 in which each portion of each side of said top tray is a raised ridge formed in said synthetic plastic material which is generally flat and includes a generally flat and broad ridge top extending between the outer perimeter of said top tray and the locating depressions closest to the perimeter of said top tray.

3. A container packaging system as in claim 2 in which each said locating depression formed in said top tray includes a generally tapered surface extending from a larger diameter at the opening of said locating depression an tapering to a smaller diameter deeper into said locating depression and which changes to a non-tapered, generally cylindrical shape between the smaller-diametered end of said tapered surface and the bottom of said locating depression.

4. A container packaging system as in claim 3 in which said top tray is formed to include generally straight ridges of said synthetic plastic material extending between adjacent pairs of said locating depressions to enhance the structural rigidity of said top tray.

5. A container packaging system as in claim 4 in which said generally straight ridges of said synthetic plastic material formed in said top tray extend between the tapered portions of said locating depressions.

6. A container packaging system as in claim 1 in which each said locating depression formed in said bottom tray includes protuberances for gripping and holding a bottle within said locating depression.

7. A container packaging system as in claim 6 in which said protuberances in each said locating depression in said bottom tray are tapered, elongated projections extending generally inward into said locating depression from opposed locations within said locating depression.

8. A container packaging system as in claim 1 in which said bottom tray includes locating depressions only for receiving the bottom ends of bottles and said top tray includes locating depressions only for receiving the top ends of bottles such that said container packaging system will receive and package only bottles which are oriented in the same direction to one another.

* * * * *